US005524374A

United States Patent [19]

Gernstein

[11] Patent Number: 5,524,374

[45] Date of Patent: Jun. 11, 1996

[54] KIT FOR RETROFITTING A SHOTGUN WITH A RECOIL REDUCTION MEANS

[76] Inventor: Terry M. Gernstein, 1015 Salt Meadow La., McLean, Va. 22101

[21] Appl. No.: 315,442

[22] Filed: Sep. 30, 1994

Related U.S. Application Data

[63] Continuation-in-part of Ser. No. 180,325, Jan. 12, 1994.

[51] Int. Cl.[6] ..... F41A 1/08; F41A 25/00

[52] U.S. Cl. ..... 42/1.06; 89/42.01

[58] Field of Search ..... 42/1.06; 89/1.7, 89/1.701, 1.702, 42.01

[56] References Cited

U.S. PATENT DOCUMENTS

| | | | |
|---|---|---|---|
| 1,227,161 | 5/1917 | Lehmann et al. | 89/42.01 |
| 3,307,451 | 3/1967 | Bucklisch et al. | 89/1.701 |
| 3,650,060 | 3/1972 | Schubert | 42/1.06 |
| 4,492,050 | 1/1985 | Kagehiro | 42/1.06 |
| 4,514,921 | 5/1985 | Bukleca | 42/1.06 |
| 4,644,930 | 2/1987 | Mainhardt | 42/77 |

FOREIGN PATENT DOCUMENTS

| | | | |
|---|---|---|---|
| 50093 | 2/1990 | Japan | 89/1.701 |

*Primary Examiner*—Stephen C. Bentley
*Attorney, Agent, or Firm*—Terry M. Gernstein

[57] ABSTRACT

A shotgun, such as a pump shotgun is retrofit with a kit that neutralizes or counters the recoil associated with firing the shotgun. The kit includes either a mechanical system or an electrical system or an electro-mechanical system and is activated by sensors or elements on the shotgun to deliver impact energy to the shotgun in a direction opposite to that of the recoil energy and at a time that is selected to most effectively neutralize that recoil energy. One form of the impact-delivering system includes a spring-biased weight that impacts a stop on the shotgun, and another form of the system includes a solenoid-controlled impact-delivering weight. A third form has a spring-assisted plunger of a solenoid-controlled impact-delivering element. The sensors are connected to the impact-element releasing system by a circuit that can include a sensitivity setting element whereby a user can adjust the sensitivity and/or the timing of the system to meet his or her needs and to account for changing conditions.

16 Claims, 7 Drawing Sheets

KIT FOR RETROFITTING A SHOTGUN WITH A RECOIL REDUCTION MEANS

CROSS REFERENCE TO RELATED APPLICATIONS

The present application is a continuation-in-part of application Ser. No. 08/180,325, filed on Jan. 12, 1994, the disclosure of which is incorporated herein by reference.

TECHNICAL FIELD OF THE INVENTION

The present invention relates to the general art of hand-held weapons, and to the particular field of shotguns.

BACKGROUND OF THE INVENTION

Sport shooting, especially shooting with a shotgun, has become increasingly popular. Such sport shooting includes target shooting as well as trap shooting in addition to hunting. As the popularity of this sport increases, more women, novices and children are becoming interested in the sport. Additionally, competition events are becoming even more popular.

While such sport shooting is generally safe under proper conditions, there are some drawbacks to the firing of a shotgun. The drawbacks of interest to this invention are associated with the recoil of the weapon. These drawbacks may be exacerbated when the person firing the weapon is a novice, a child, or someone of slight stature who is not used to firing a weapon such as a shotgun that has a recoil. This recoil can range from slight to very heavy depending on shot size, and can be a problem if the weapon is fired repeatedly or for long periods of time, such as might occur during a competition. Such recoil may discourage some people from the sport.

Therefore, there is a need for a system that effectively and efficiently absorbs or neutralizes recoil of a weapon such as a shotgun.

The art includes many inventions that are intended to reduce the recoil felt by the shooter. An example of such an invention is disclosed in U.S. Pat. No. 4,492,050. However, inventions, such as the just-mentioned patented invention, require a gas system to reduce this recoil. Gas systems require ports and conduits, which may become clogged due to the residue associated with the powder used in ammunition fired by shotguns. Once the ports or conduits of the gas system become clogged, the efficiency of the recoil system can be inhibited if not totally vitiated. The art also contains some examples of recoil control systems that include cushions and the like. These systems do not absorb recoil, they merely alter the time the recoil is felt by the shooter. While this delaying process can be effective in some instances, it is not completely effective in all situations for all shooters.

Therefore, there is a need for a system that can be used on a shotgun that prevents recoil-associated energy from reaching the shooter, but will not be adversely affected by the products associated with the normal firing of the ammunition fired by the shotgun.

Still further, operation of weapons, such as a shotgun, may cause the barrel of the weapon to rise. While most shooters learn to compensate for barrel rise, some shooters never learn to effectively and completely compensate for barrel rise. In fact, the outcome of some competitions may even be affected by how well the competitors continue to compensate for barrel rise as the competition enters its final phases. This compensation can be affected by recoil as well if the shooter becomes tired and the recoil wears on him or her. Recoil and barrel rise are even more critical if rapid firing is required. All of the above-mentioned factors are made even more important if the shooter is young, a novice or the like.

Therefore, there is a need for a recoil reduction system that can be used on a shotgun which also reduces barrel rise associated with the firing of the weapon.

Due to the increasing popularity of shooting, many people are using shotguns for several different purposes. For example, a shotgun originally purchased for hunting might be used in competitions, or in trap shooting. It is simply too expensive for many people to purchase several different shotguns. From the foregoing discussion of recoil and barrel rise, it can be understood that there are different constraints placed on weapons used for hunting and weapons used for competition shooting. Therefore, to be most effective, a user should purchase a competition weapon if he or she already owns a hunting weapon or vice versa. This can be expensive.

Therefore, there is a need for a recoil absorption system that can be retrofit onto an existing weapon to make that weapon effective as both a hunting weapon and a competition weapon and can be changed to alter the characteristics and response of the weapon as that weapon is used for different purposes. In fact, it would be ideal if a shooter could alter the response characteristics of the weapon quickly and accurately whereby these responses could be changed to meet changing conditions, such as during a long competition or the like. This would permit a shooter to reduce recoil as a competition progresses.

Still further, if a weapon is used by more than one person, and one person is more sensitive to recoil than the other, the weapon should be set up to satisfy the needs of the more sensitive user. Therefore, in some instances, more than one weapon is required if a second shooter in the family takes up the sport. This also is expensive.

Therefore, there is a need for a recoil reduction system that can be retrofit onto an existing weapon to make that weapon useable by a shooter who is sensitive to recoil and can be changed by that shooter or another shooter using that weapon to suit his or her requirements.

The recoil absorption means disclosed in the parent application meets many of these needs by effectively absorbing recoil energy in a hand-held shotgun. While effective, the recoil absorption means disclosed in the parent application is most efficiently incorporated into the shotgun by the manufacturer. This meets the needs of new guns; however, there is a large market for retrofitting existing shotguns with a recoil absorption means such as disclosed in the parent application. This will permit those people who already own a shotgun to take advantage of the recoil absorption means disclosed in the parent application without requiring them to purchase a new shotgun. If an easily installed retrofit kit is available, a shooter could purchase several kits to modify a single weapon as necessary. They will only need to purchase a retrofit kit and modify their shotgun with that retrofit kit.

However, the modifications required to incorporate the retrofit kit into an existing weapon must be simple and inexpensive and should not unduly alter the appearance or "feel" of the shotgun, otherwise there may be little motivation for a shotgun owner to modify his or her shotgun.

Furthermore, if a retrofit kit could be modified after installation to account for changed conditions, such a kit could be installed on a single shotgun and extend the range of uses available for that weapon.

Therefore, there is a need for a retrofit kit that can be used to easily and inexpensively modify an existing shotgun to include a recoil absorption means disclosed in the parent application and which, once installed, can be modified to meet changing conditions of use.

OBJECTS OF THE INVENTION

It is a main object of the present invention to retrofit a shotgun with a recoil reduction system which significantly reduces the amount of recoil energy that is applied to a shooter.

It is another object of the present invention to retrofit a shotgun with a recoil absorption means that has all of the advantages achieved by the recoil absorption means disclosed in the parent application.

It is another object of the present invention to retrofit a shotgun with a recoil reduction means that does not unduly alter the appearance, "feel" or balance of the shotgun.

It is another object of the present invention to retrofit a shotgun with a recoil reduction means that is easily installed or removed by a shooter.

It is another object of the present invention to retrofit a shotgun with a recoil reduction means that, once installed, can be modified to meet changing use conditions.

SUMMARY OF THE INVENTION

These, and other, objects are achieved by a retrofit kit which includes an impact-delivering system that delivers an impact to the shotgun when recoil energy that would act on a shooter reaches a predetermined level. The impact energy is directed opposite to the recoil energy to counteract that recoil energy. For the sake of convenience, the term "absorption" will be applied to the action of the retrofit kit of the present invention and will include reduction, absorption, countering and neutralization of the recoil energy that would be imparted to a shooter.

The retrofit kit can be entirely mechanical, or entirely electrical, or a combination thereof. Specifically, the impact element can be electronic, mechanical or electro-mechanical. One form of the invention includes a spring-controlled weight element slidably mounted on a magazine tube of the weapon. The weight element is located in a rest position at initiation of the firing sequence. The weight is held in place by a lock and is spring biased toward the other end of that tube to move toward that other end when the lock is disengaged. The weight element impacts a stop element fixed to the shotgun to generate the recoil energy neutralizing impact. Means, fixed to the forearm of the shotgun, cooperates with means on the impact element to move that element back to a rest position spaced from an impact-delivering position by a suitable distance when the forearm is operated. The weight can be held in its rest position by a lock such as disclosed in the parent application.

Another form of the retrofit kit includes an electrical system which has an electronically controlled and driven impact element. This form of the invention includes a stop element fixed to the shotgun and a coil-controlled ram or plunger that moves from a rest position spaced from the stop element into contact with the stop element upon actuation of the coil. The ram is moved back to the rest position upon deactivation of the coil. The coil can be energized to move the ram back to its rest position as the weapon is being recycled for firing the next round, or a means such as used in the mechanical form to move the weight in conjunction with the forearm, can be used with the coil being de-energized for such return movement.

An electro-mechanical form of the kit includes a spring-biased ram that is moved by both the spring and a coil. The spring assists the coil in accelerating and moving the impact element whereby proper timing of and energy associated with the impact are assured. The coil can be energized as above discussed, or the mechanical resetting means mentioned above can be used, or a combination of the two can be used to move the impact-delivering element back to its rest position after an impact has been delivered.

In addition to, or in place of, the mechanical release means disclosed in the parent application, the retrofit kit can include sensing means on the shotgun that sense various conditions in the shotgun, such as pressure, temperature, strain on a selected location, or on selected locations, of the shotgun as well as acceleration of barrel rise during recoil. The sensors can be located in the gas port bores of existing weapons, such as the weapon disclosed in the 4,492,050 patent. The bores are closed by the sensors, and are merely a convenient location for the sensors, with it being understood that the sensors can be located anywhere on the weapon. There are no gas ports such as are disclosed in the prior art in the retrofit kit of the present invention. The sensors are connected to a means that either activates the coil or moves a lock to disengage the lock from the weight or the impact element at a preselected time during the firing sequence of the shotgun so the impact element reaches the impact-delivering location when it is most appropriate for the impact on the shotgun to counteract or neutralize the recoil energy. The recoil of the weapon is thus neutralized by impact energy. The impact element moves between a rest location spaced from the stop element and an impact-delivering position abutting the stop element. The rest position is located with respect to the impact-delivering position to ensure that the impact element will move into contact with the stop element at the proper time. The rest and stop positions have elements fixed to the shotgun.

The retrofit kit of the present invention is easily attached to a shotgun by, for example, simply placing a sensor on the shotgun, such as in the barrel, and placing the impact-delivering system on the magazine tube presently available on the shotgun. An example of such a presently available shotgun is disclosed in U.S. Pat. No. 4,492,050, the disclosure of which is incorporated herein. The solenoid-operated element or the weight is located on or in the magazine tube and is moved from the impact-delivering location back to the rest position by the forearm. The impact-delivering system of the present invention is located in the magazine tube in place of the gas-controlled recoil absorbing system presently located in that tube, and the sensors can be attached to the shotgun via the gas ports that are presently located on the shotgun. The control system for the impact-delivering element is attached to the barrel, or can even be located inside the stock or in the forearm with proper sliding electrical contacts whereby the appearance of the presently available shotgun is not changed in any significant way. The control system can include means for setting the sensitivity of the release system whereby the impact can be timed to occur at the time most desired by the user for neutralizing the recoil energy. The user can then adjust the timing to account for various conditions that may be encountered during use, such as to account for the effects of aging.

Specific forms of the impact element control include a switch that has sensors, such as pressure sensors, temperature sensors, strain gages, accelerometers, or the like, or a combination thereof, to activate the impact-delivering system when the sensed condition or conditions reach a preset level or levels. These preset levels can be set at the factory, or in the field by the user.

The recoil reduction system of the present invention permits a user to retrofit an existing weapon with the recoil reduction system and permits those shotgun owners to realize the advantages of an effective recoil reduction system. This opens up a large retrofit market and makes such technology accessible to all shotgun owners without requiring them to purchase entirely new weapons.

BRIEF DESCRIPTION OF THE DRAWING FIGURES

FIG. 1 is a side elevational view of a prior art pump shotgun such as disclosed in incorporated document, U.S. Pat. No. 4,492,050.

Figure 5:
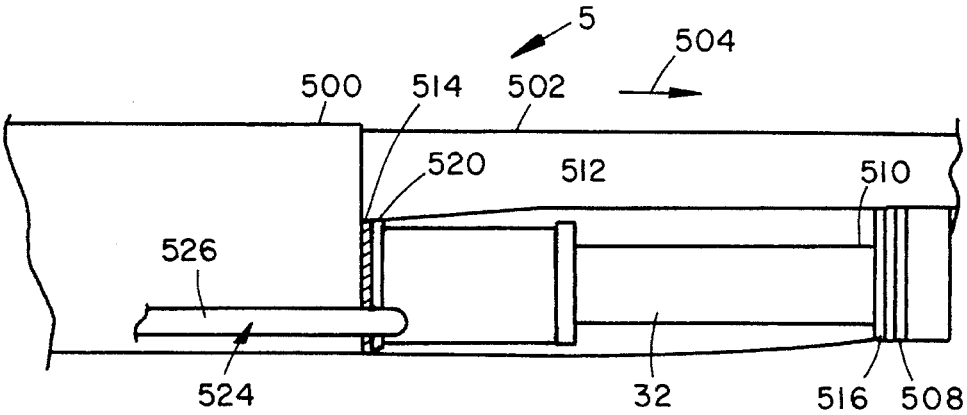
Figure 14A:
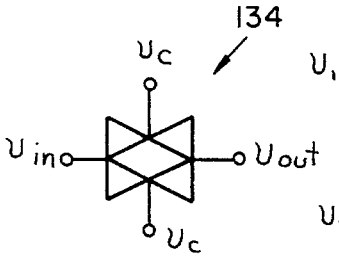
Figure 14B:
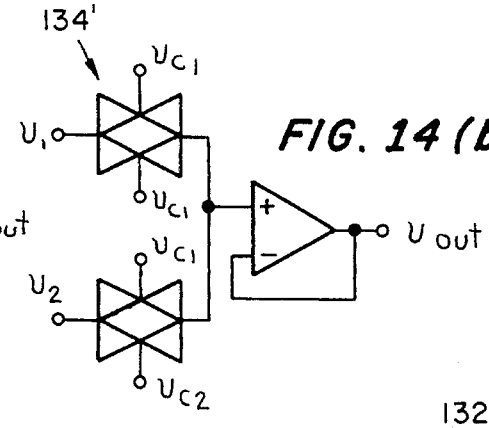

FIG. 5 corresponds to FIG. 14 of the parent application and shows a side elevational view of a portion of a pump shotgun which includes a mechanical recoil absorption system which uses a weight as the impact-delivering element to neutralize recoil energy.

Figure 6:
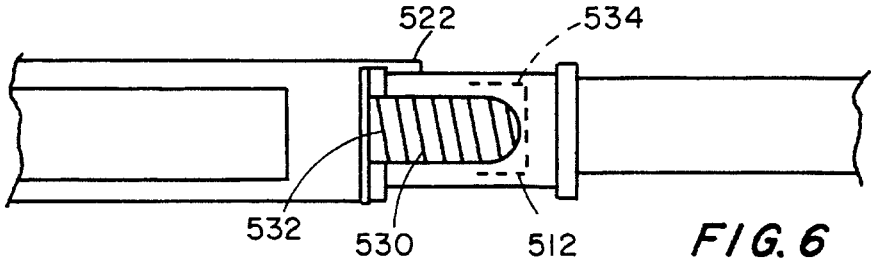
Figure 15:
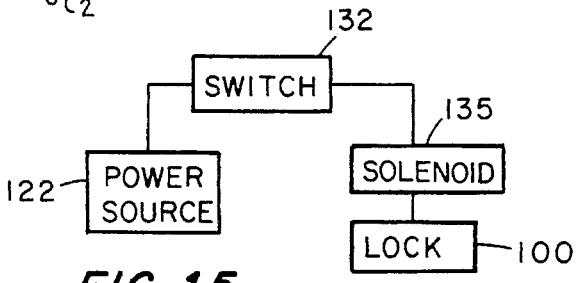

FIG. 6 corresponds to FIG. 15 of the parent application and shows a bottom plan view of the FIG. 5 pump shotgun, with a portion of a weight element cut away.

Figure 7:
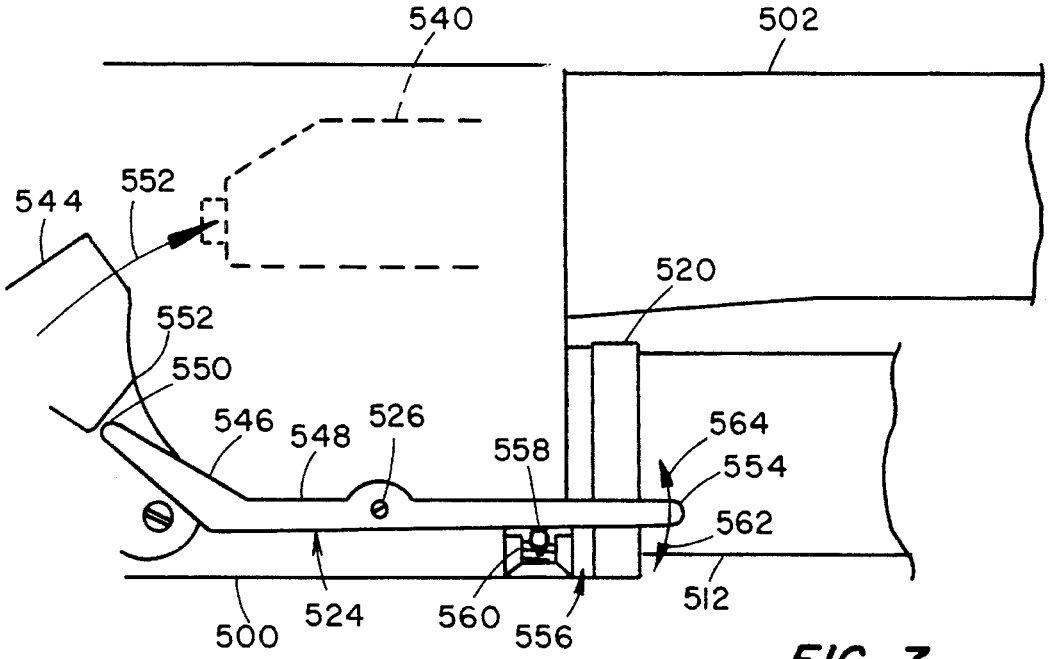
Figure 16:
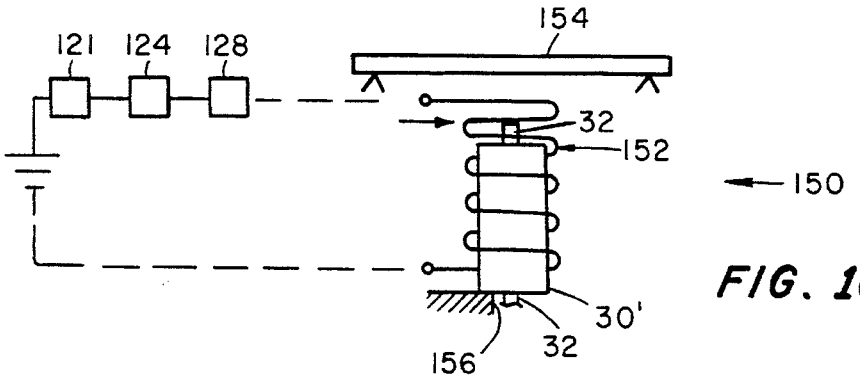

FIG. 7 corresponds to FIG. 16 of the parent application and shows a partially cutaway side elevational view of a receiver section of the pump action shotgun.

Figure 8C:
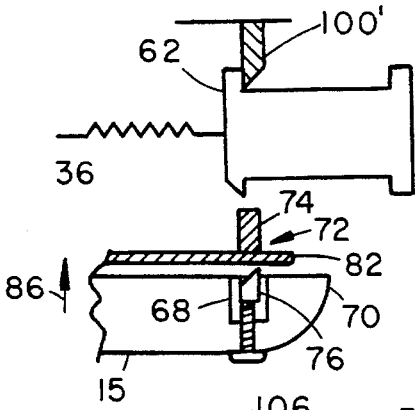
Figure 8B:
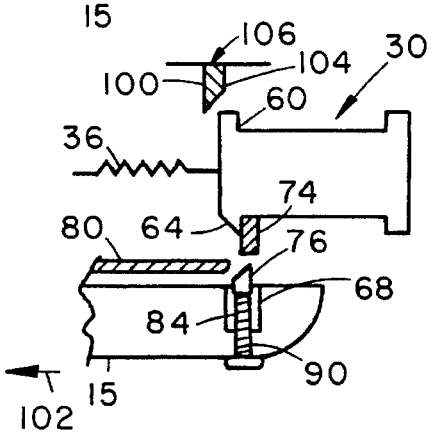
Figure 8A:
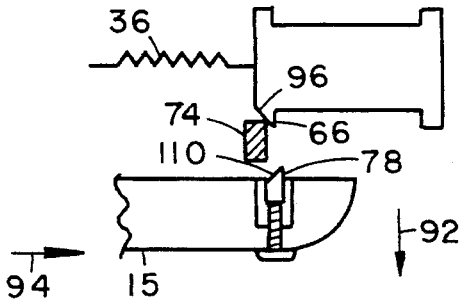

FIGS. 8A–8C illustrate a means for releasably locking the impact-delivering element to a forearm of the shotgun to move that impact-delivering element from an impact-delivering position shown in FIG. 8A, back to a rest position shown in FIG. 8C and releasing that impact-delivering element from the forearm and placing it under the control of a switch that is controlled by a condition in the weapon associated with recoil energy to be released when most effective for absorbing or neutralizing recoil energy.

Figure 9:
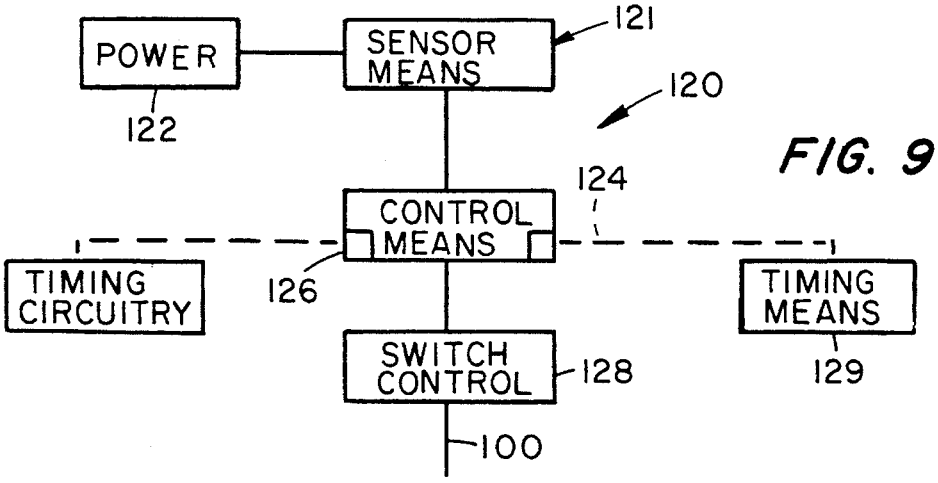

FIG. 9 is a block diagram illustrating a system that is used to activate and control operation of the recoil neutralizing system of the present invention.

Figure 10:
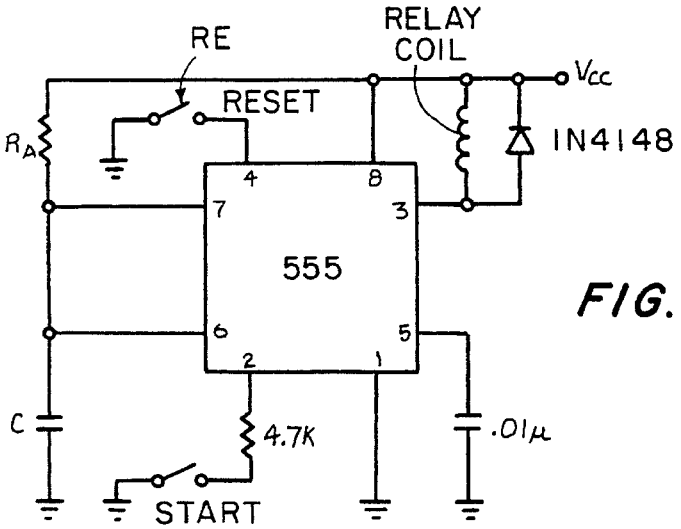

FIG. 10 is a schematic showing a timing means used to release and reset the lock portion of the control circuit.

Figure 11:
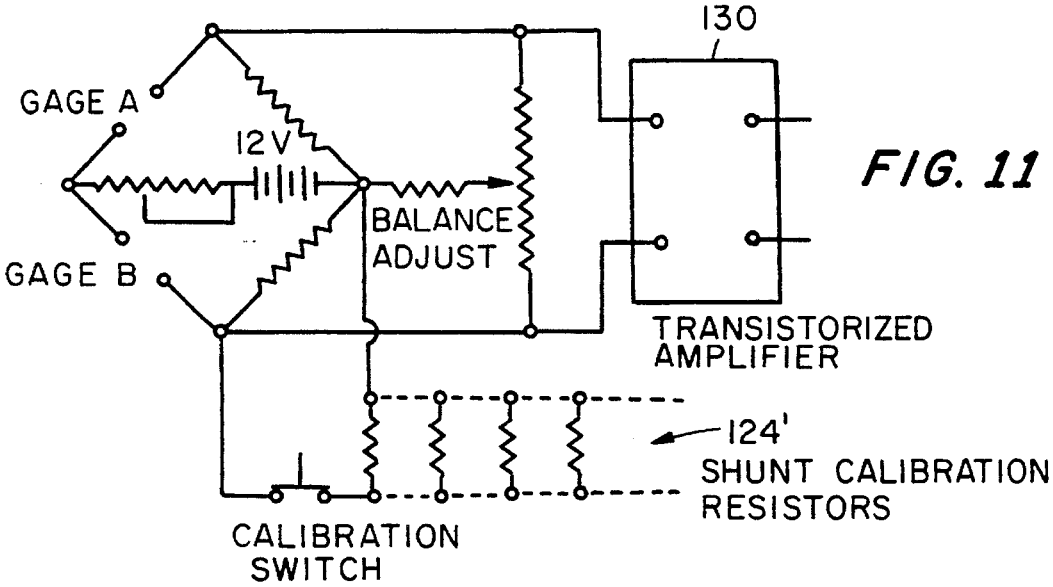

FIG. 11 shows a sensor circuit that can be used in the retrofit kit of the present invention.

Figure 12:
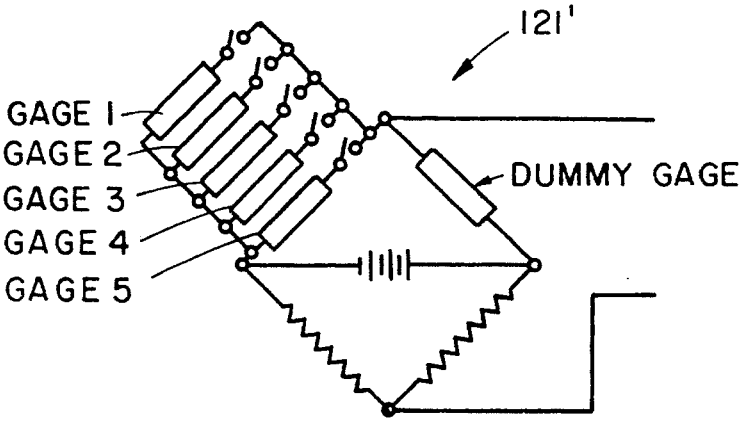

FIG. 12 shows another sensor circuit that can be used in the retrofit kit of the present invention in which a plurality of sensors are used.

Figure 13A:
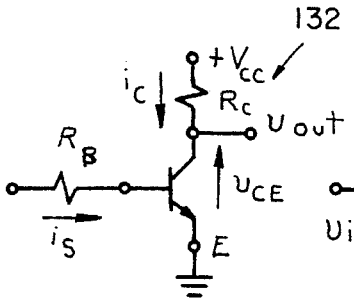
Figure 13B:
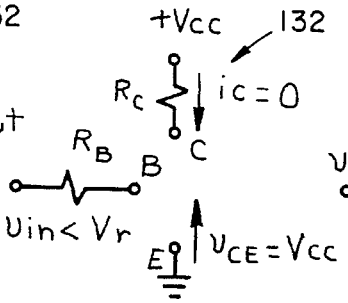
Figure 13C:
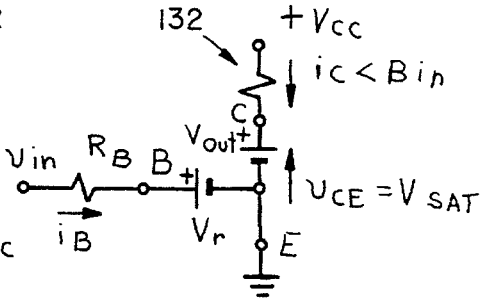

FIGS. 13(*a*)–13(*c*) show a switch that can be used in combination with the sensors to release the lock holding the impact-delivering means in its rest position.

FIGS. 14(*a*) and (*b*) show further forms of a switch that can be used to control the lock.

FIG. 15 is a block diagram illustrating an electrical lock control system used in the recoil reduction system.

FIG. 16 is a schematic showing the electrical form of the impact-delivering system.

Figure 17:
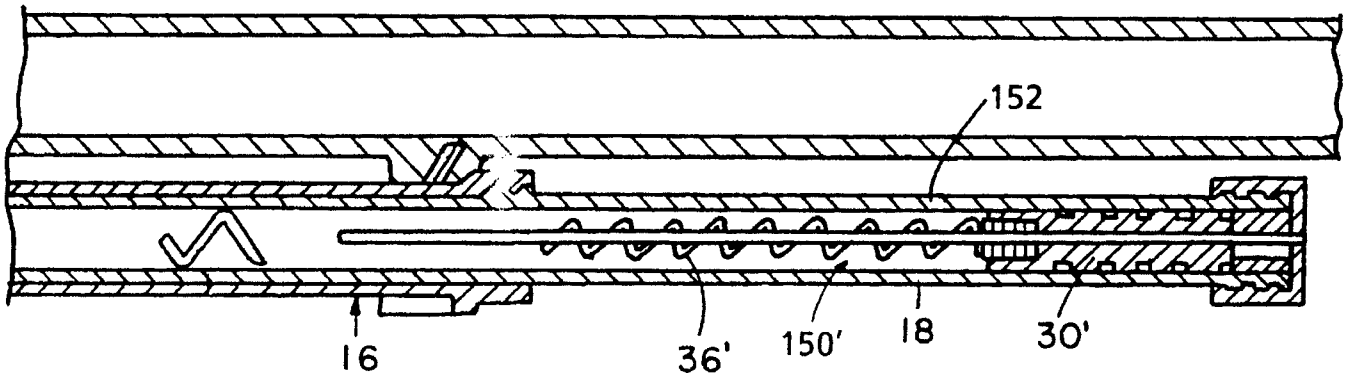

FIG. 17 shows an electro-mechanical form of the impact-delivering system in place in a shotgun, with the impact-delivering element in impact-delivering position.

Figure 18:
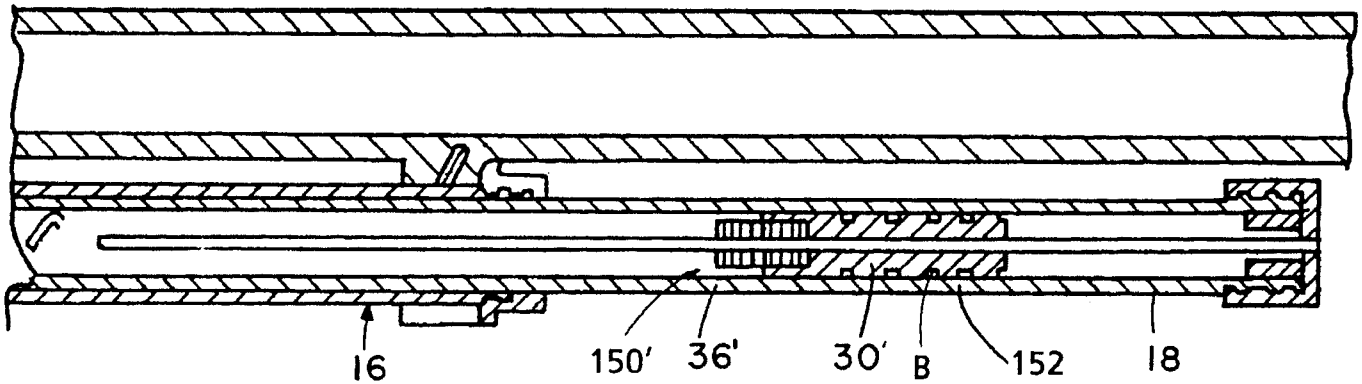

FIG. 18 shows the FIG. 17 form of the system with the impact-delivering element spaced from the impact-delivering position.

DETAILED DESCRIPTION OF THE PREFERRED EMBODIMENT OF THE INVENTION

Figure 1:
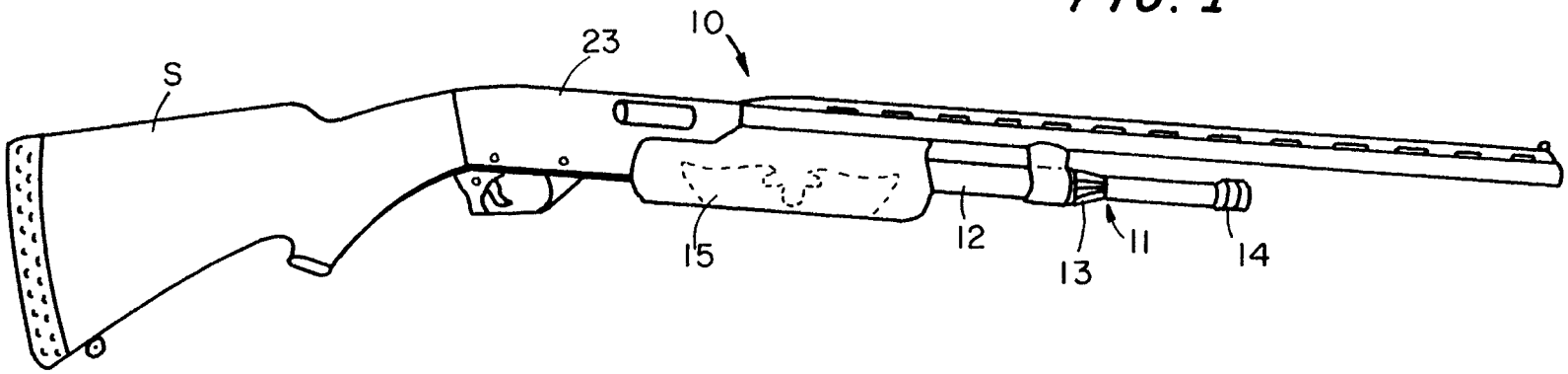

Shown in FIG. 1 is a shotgun 10 of conventional design, for example a Remington 870 standard pump shotgun, a Remington 1100, or the like. Shotgun 10 could also be a Winchester shotgun, a Mossberg shotgun, or the like. Therefore, while a Remington shotgun is shown, it is understood that other shotguns can also be retrofit using this invention. Fitted onto shotgun 10 is a recoil reducer device 11 which extends into the gun's magazine tube 12 and which has a threaded cap-like sleeve member 13 which screws onto a threaded end of magazine tube 12. A threaded cap 14 closes the forward end of the recoil reducer device. Gun 10 is shown with a forearm 15 pulled back into a rest position.

Figure 2:
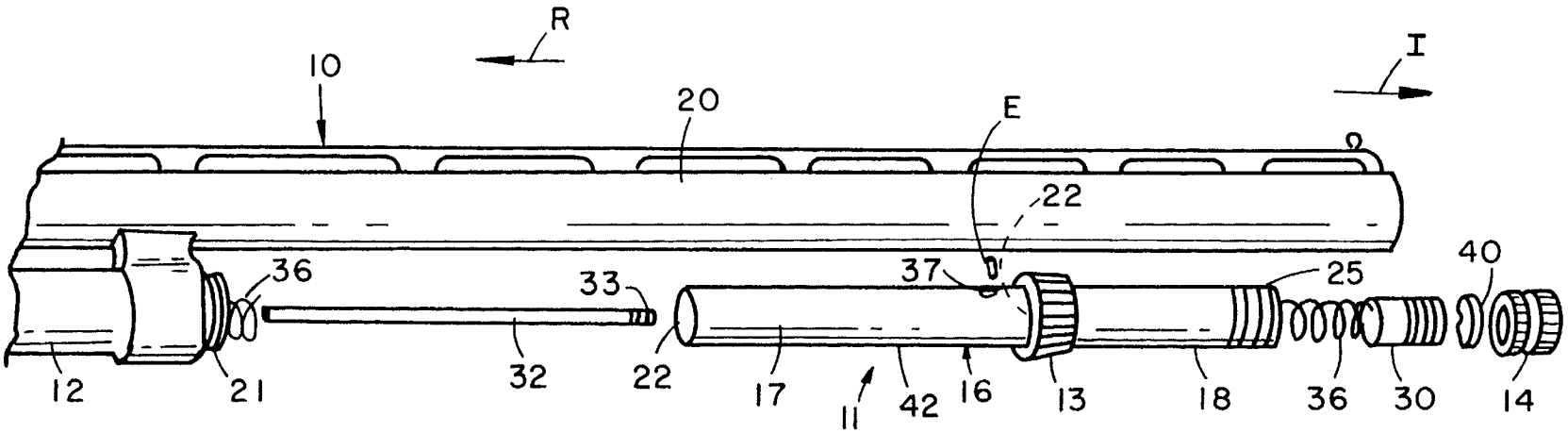
FIG. 2 is an exploded perspective view of the FIG. 1 shotgun which has been modified to replace the recoil absorption system of that shotgun with the recoil reduction retrofit kit of the present invention.

The retrofit kit of the present invention is located in the recoil reducer device 11 and magazine tube 12 and is shown, in a general manner, in FIG. 2. By fitting the recoil reduction device of the present invention into the recoil reducer device 11 and tube 12, gun 10 can be easily retrofit without requiring major changes to the existing gun. As shown in FIG. 2, recoil reducer device 11 includes an elongated cylinder tube 16 having a rearwardly extending reinforcing sleeve 17 and a forward extension 18 which projects forward from the magazine tube 12. A barrel ring 19 is fixed to the shotgun, and magazine tube 12 contacts ring 19 with external threads 21 extending forward of the ring. Reinforcing sleeve 17 has threads 22 that connect sleeve 17 to tube 12 and thus to the shotgun. One end of tube 12 is fixed to the shotgun adjacent to receiver section 23. Extension 18 is closed by means of cap 14 being threadably engaged on extension 18 via threads 25.

Figure 3:
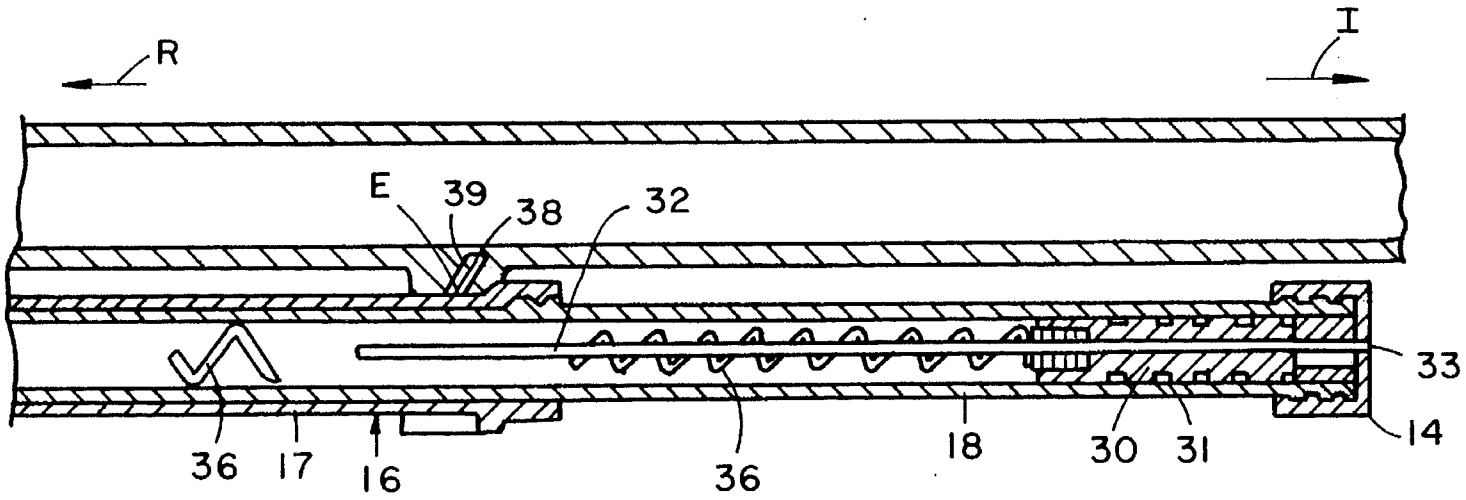
FIG. 3 is a side elevational view showing the impact-delivering system of the present invention broadly fit into a shotgun such as shown in FIG. 1, with the system in the impact-delivering position.
Figure 4:
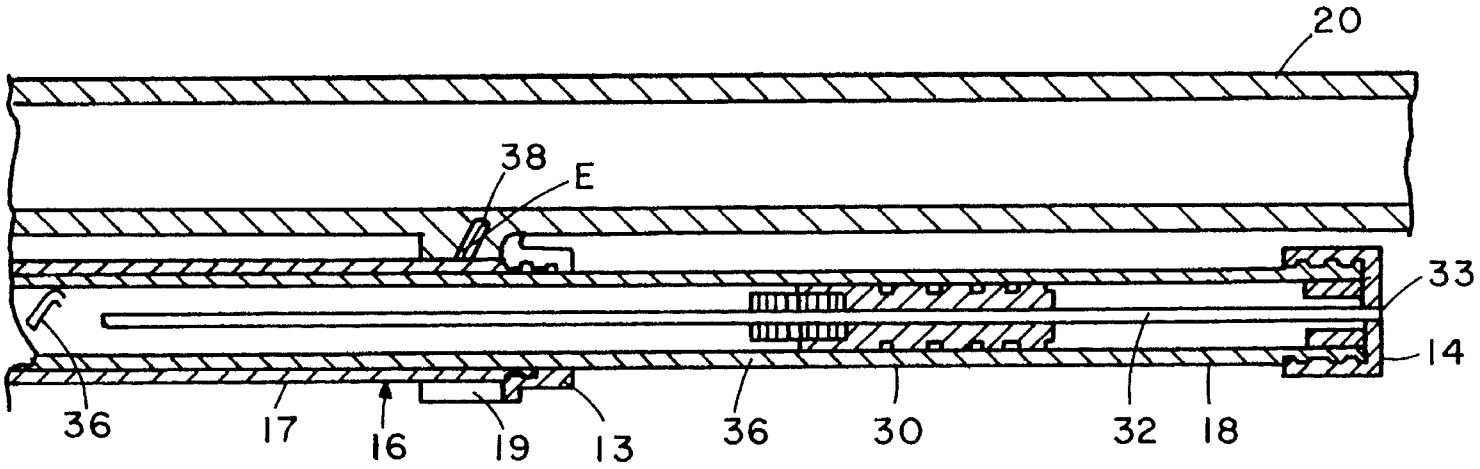
FIG. 4 shows the system shown in FIG. 3 in a configuration with the impact-delivering element spaced from the impact-delivering position thereof.

The retrofit kit of the present invention is located inside reducer device 11, and includes, broadly, an impact element 30 that moves between an impact-delivering position, such as adjacent to end cap 14, and a rest position spaced from that impact-delivering position. In some cases, the rest position can be adjacent to the receiver, but this rest position is selected according to constraints that will be understood by one skilled in the art based on the teaching of this disclosure and suitable elements can be placed inside reducer 11 to fulfill the rest and impact functions. For example, the rest position is closer to the impact-delivering position if the time of impact is soon after firing a round; whereas, the rest position is farther from the impact-delivering position when impact is to be delayed. Constraints, such as when the maximum recoil will be delivered to a shooter, speed of movement of element 30, speed of the release of element 30, and the like, will be factored into the relationships used to determine the location of the rest position with respect to the impact-delivering position. An impact-delivering position is indicated in FIG. 3, and a rest position is indicated in FIG. 4 for reference. It is noted that an early impact may be preferred by some shooters so if there is a time difference, the gun will be moved away from the shooter before the recoil reaches its maximum. On the other hand, some shooters may prefer to have a late impact so the danger of dropping the gun is reduced. The retrofit kit of the present invention has means that permit a shooter to adjust the time of impact to suit his or her needs.

In one form of the retrofit kit, element 30 slides inside the extension 18, and can include ball bearings 31, or the like, and can be guided by a rod 32 attached at one end to cap 14 by threads 33, and at the other end to the shotgun, such as in the receiver. Other forms of the retrofit kit can have the weight slide on the outside of the tubes 17 or 18 and the impact-receiving element can be the ring 19 if desired. Rod 32 is shown broken away in FIG. 2 for the sake of illustration. Element 30 is moved by a biasing means, such as a spring 36 having one end thereof mounted on the shotgun, such as at the receiver section, and having the other end thereof attached to element 30. Spring 36 biases element 30 strongly toward the impact-delivering position, and a release system is used to time the release of element 30 as will be understood from the following discussion. Sleeve 17 includes a bore 37 through which an electrical cord, indicated in FIG. 2 by reference indicator E, is received for electrically connecting a sensor 38 that can be located in barrel 20 in the gas port 39 that is defined in this barrel and described in the incorporated patent as gas port (numeral 37 in the referenced patent '050), to a control system for releasing element 30. The cord E can fit into a conduit in extension 18 or in a groove defined in that extension or the tube if necessary. It is noted that the gas conducting means, i.e., the gas port of the '050 patent, as such is not present in the retrofit kit of the present invention as that "gas port" has been deleted, and changed into a means for accommodating the sensing means of the present invention. The gas port means of the '050 patent and other such weapons, may become clogged with powder particles during use, and should be periodically cleaned. No such drawback is associated with the retrofit kit of the present invention because gas is not conducted through port 39. The electronic control system can be located in stock S, or some other convenient position. Those skilled in the art will understand where to place the control system based on the teaching of this disclosure.

A washer 40 is located to be between element 30 and the impact-receiving element, such as cap 14 in FIG. 3. Another washer can also be located to be between element 30 and the remainder of the shotgun when element 30 is in the rest position, if suitable.

As will be appreciated from the teaching of the present disclosure, prior to firing shotgun 10, element 30 is in the rest position. When shotgun 10 is fired, some property or condition that is associated with generating recoil of the weapon is used to release the element. Once released, element 30 moves toward the impact-delivering position. The release of element 30 is timed so that it delivers impact energy to the shotgun when it is most desirable to counter the recoil energy associated with firing the shotgun. That is, impact energy is delivered to the shotgun in direction I when it is most efficient in countering recoil energy R. After firing, forearm 15 is moved from the FIG. 1 position to a forward position, and then back to the FIG. 1 position. The forearm includes coupling means, to be described later, for releasably engaging element 30 and moving it back to the rest position during this movement of the forearm back to the FIG. 1 position. A slot 42 can be defined in tube 16 to permit the coupling means on the forearm to connect to element 30 if element 30 is located inside reducer 11.

One specific form of the retrofit kit of the present invention is shown in FIGS. 5–7, and corresponds to the sliding weight described in the parent application. This description is incorporated herein, and will be presented herein as presented in the parent application with the same reference numbers for the sake of convenience.

A weight element 512, corresponds to element 30 discussed above, and is hollow and cylindrical and is slidably mounted on the magazine tube 32' in a manner similar to the mounting on rod 32 discussed above such as on rod 32. The weight slides between a rest location shown in FIG. 5 adjacent to the receiver, and an impact-delivering location adjacent to lug 508, which corresponds to cap 14 or to barrel ring 19 for example, and is the impact-receiving location, but which can be located in any convenient location, in response to firing of shotgun 10. A washer, such as a "DELRIN" plastic washer 514 corresponding to washer 40, is mounted on the magazine tube to be interposed between weight 512 and the receiver, while a second washer 516 is also mounted on the magazine tube to also be interposed between weight 512 and the impact-receiving element. The weight contacts the washers in its end locations.

Weight 512 includes a flange 520 that is engaged by hook 522 located on a forward end of a lever-like lock element 524. Lock element 524 is pivotally mounted on receiver 500 by pivot pin 526 located near the center of the lock element. The lock element and its operation will be discussed in greater detail below, and can be located inside tube 16.

A progressive rate compression spring 530, corresponds to spring 36, surrounds rod 32 and has one end 532 abutting washer 514 and a second end abutting a spring seat 534 fixed to weight 512. Spring 530 biases weight 512 toward washer 516.

As is best shown in FIG. 7, shotgun 10 includes a breech block 540 having a firing pin 542 that is located in receiver 500 and is operated in the manner common to pump shotguns. The shotgun is fired by a hammer 544 operating in the manner common to pump shotguns to strike firing pin 542. Lock element 524 includes a rear end 546 that is angled upwardly from body 548 and includes a rounded end edge 550. An angled ramp 552 is defined in hammer 544 to strike edge 550 as the hammer moves from the cocked position shown in FIG. 7 to a firing pin striking position as indicated by arrow 554. Lock 524 is pivoted to move hook 522 in directions indicated by arrow 554 shown by the double-headed arrow in FIG. 7 in the manner of a first degree lever. A spring 556 is based on receiver 500 and has a ball 558 attached to the other end thereof and is guided by an appropriate spring guide 560 to engage the lock arm and bias that arm downwardly as indicated by head 562 of the double-headed arrow. Upon end 550 engaging ramp 552, the lock arm is moved upwardly as indicated by head 564 of the double-headed arrow. The length of lock 524 can be adjusted or the bias of the spring element can be adjusted to adjust the distance between the rest position of the impact-delivering element and the impact-delivering position of that element.

When hook 522 moves in direction 564, it is moved out of locking engagement with flange 520 thereby releasing the weight. Once released, the weight moves under the influence of spring 530 from the rest location towards the impact-delivering location. Weight 512 is moved back to the rest location from the recoil location by moving the forearm 15 during the cocking procedure.

The characteristics of spring 530, the mass of weight 512, the size, angle and location of ramp 552 are all selected so that weight 512 contacts washer 516 at or near the time pressure in the barrel reaches its maximum as the shot moves down the barrel after firing.

The contact between weight 512 and washer 516 creates impact force on shotgun 10 that is directed forwardly of that shotgun. The recoil force associated with the firing of the weapon creates a force directed rearwardly of the weapon. Thus, the recoil force is countered by the force associated with the impact between weight 512 and washer 516. This impact force is sized whereby the user feels little if any force on his or her body due to the counteraction of forces.

As mentioned above, element 30 is moved from the impact-delivering position back to the rest position when forearm 15 is moved back to the FIG. 1 position. The means for releasably attaching element 30 to forearm 15 to achieve this is shown in FIGS. 8A–8C. This means includes a flange 60 on element 30 having a square shoulder section 62 and a sloped shoulder 64 on another section of that flange. A planar portion 66 is also located on the flange near sloped shoulder 64. The forearm includes a bore 68 defined near front end 70 thereof. An element 72 is mounted on the forearm and includes a first section 74 and a second section 76 separated by a bore 78 defined through element 72 and which is sized to receive rod 80 having a rounded distal end 82 and a proximal end mounted on the shotgun. A spring 84 is seated on the forearm and engages element 72 to urge that element upward out of bore 68 toward the path traveled by element 30 as indicated by arrow 86 in FIG. 8C. A screw adjustment mechanism 90, such as described in the parent application, is used to adjust the bias exerted on element 72 by spring 84.

The released configuration of element 30 is shown in FIG. 8A just before that element is attached to the forearm by the attaching means. As can be seen, sloped shoulder 64 engages element 74, and forces element 72 downward in direction 92 as the forearm is moved in direction 94 with respect to a stationary element 30. As the forearm moves in direction 94, element 72 is moved into bore 68 against the bias of spring 84 and element portion 74 moves downwardly and past flange 60. As soon as element portion 74 moves past tip 96 of flange 60, spring 84 urges that element portion into position engaging element 30 as shown in FIG. 8B whereby element 30 is attached to the forearm. After the forearm has moved back toward the FIG. 1 position, element 30 will be located adjacent to a lock element 100 as shown in FIG. 8B. Further movement of the forearm in direction 102 draws element 30 in position so sloped surface 104 of lock element 100 slides over flange 62. Lock element 100 is spring loaded by spring 106 to move into and out of a bore in the shotgun to permit flange 60 to move past the lock element, but to force the lock element into locking position shown in FIG. 8C as soon as the flange has moved past the lock element. Lock element 100 is operated by a system to move into an element releasing position shown in FIG. 8C in dotted lines and indicated by reference numeral 100' in timed relation to the firing of the weapon so element 30 will move under the influence of spring 36 as above described. Means for moving the lock element can be controlled and reset as will be discussed below whereby the lock can move to permit element 30 to move therepast from the FIG. 8B position to the FIG. 8C position, yet will permit the lock to be moved from the full line position shown in FIG. 8A engaging flange 62, to an element-releasing position shown in dotted lines in FIG. 8A by the system disclosed hereinbelow. An example of this is a spring-biased solenoid-operated plunger which is controlled by a timer element. In this system, the solenoid is deactivated when it is desired to have the plunger controlled solely by the spring to permit element 30 to be moved past the lock from the FIG. 8B position to the FIG. 8C position, and then reactivated so the plunger, i.e., the lock 100, is held in place and can be moved only by activating the solenoid which moves the plunger against the bias of the spring.

Element 72 is released from element 30 by rod 80 engaging sloped surface 110 on element portion 76 as the forearm is moved back into the FIG. 1 position. As rod 80 engages sloped surface 110, further movement of the forearm in direction 102 forces the element 72 down into bore 68 and out of engagement with flange 60. The rod prevents element 72 from re-engaging flange 60 while the forearm is in the FIG. 1 position, and the only element that prevents the element 30 from moving forward toward the impact-delivering position is lock element 100. The positions of the various elements are selected so lock 100 engages element 30 prior to element 72 being released from element 30.

The lock element can be operated by a control system 120 shown schematically in FIG. 9. System 120 includes sensor means 121, such as sensor 38, powered by a suitable source 122 and electrically connected to a control circuit 124 that includes timing circuitry 126, and to a switch control means 128 that moves lock 100. Switch control means 128 can include a solenoid or other such element that moves lock 100 as above discussed in response to receiving a signal from control means 124, which is activated by a signal from sensor means 121. Control means 124 includes timing means 129 which releases lock element 100 after a preset time to return to the locking position shown in FIG. 8B, and to reset control system 120. Timing means 128 can be any suitable timing circuit such as illustrated in FIG. 10, with the start element being operated by actuation of the control means and reset element RE being operated by the forearm as it moves away from the FIG. 1 position. Operation of the time delay shown in FIG. 10 will not be discussed since any suitable time delay circuit can be used, and one skilled in the art will be able to understand the operation of the FIG. 10 time delay circuit from the disclosure herein or from standard textbooks, such as "Encyclopedia of Electronic Circuits," Volume 1, by Rudolf F. Graf, published by TAB Books, Inc. in 1985, see FIG. 88-18, the disclosure of which is incorporated herein by reference.

As above discussed, sensor means 121 can include one or more sensors. One form of the sensor means is shown in FIG. 11 with the sensors being indicated as Gage A and Gage B. The sensor means can be calibrated to react as pressure, temperature, strain or other suitable parameter reaches a predetermined level using the means indicated in FIG. 11. The sensors can be located in the barrel of the weapon, on the barrel of the weapon, in the trigger, or in any other location on the weapon, and emit a signal that is amplified, if necessary, by amplifier 130 and sent on to the switch. A sensor means 121' is shown in FIG. 12 which includes a plurality of different sensors indicated by Gages 1–5. The gages can include an accelerometer such as disclosed in textbooks such as "Mechanical Measurements" by Beckwith, Buck and Marangoni, published by Addison-Wesley in 1982 (see Chapter 17), the disclosure of which is incorporated herein by reference. Sensitivity adjusting means is indicated in FIG. 11 by resistors 124' but could be any suitable means known to those skilled in the art based on the teaching of this disclosure.

The switch means 128 can be any suitable element, such as transistor 132 shown in FIGS. 13(*a*), (*b*) and (*c*), and fully discussed in standard textbooks, such as "Electrical Engineering concepts and applications," by A. Bruce Carlson and David G. Gisser, and published by Addison-Wesley in 1981, see, pages 356–360, the disclosure of which is incorporated herein by reference, or by CMOSS switches 134 and/or 134' shown in FIGS. 14(*b*) and (*c*) such as disclosed in standard textbooks such as the just-mentioned "Electrical Engineering concepts and applications" at pages 362–365, the disclosure of which is incorporated herein by reference, or a switch such as is used to activate an airbag in a passenger vehicle. A detailed explanation of these elements will not be presented because those skilled in the art will understand how signals and voltages received from sensor means, such as amplifier 130, will be used to close transistor 132, or to operate CMOSS switch 134 or 134' or to open it as necessary. Applying voltage to switch 132 to change it from an open, or cutoff state represented in FIG. 13(*b*) to a closed or saturated state as indicated in FIG. 13(*c*) can complete a circuit between a solenoid 135 operating lock 100 and power source 122, such as is indicated in FIG. 15.

The impact-delivering system discussed above with reference to FIGS. 5–7 is mechanical. An electrical impact-delivering system 150 is shown in FIG. 16. System 150 is a solenoid-type system which has a plunger core that corresponds to impact element 30, and which is indicated as element 30' located in a coil 152 that is embedded in tube 18. As before, element 30' can ride on ball bearings. Activation of the coil 152 by the switch means via control means 124, moves the element 30' as above discussed into contact with the abutment stop or impact-receiving element, illustrated in FIG. 16 by element 154, from the rest location illustrated by element 156. Element 30' can slide along rod 32. When a sensor element detects a condition, such as pressure, temperature, strain, acceleration associated with barrel rise or barrel movement, or the like, it emits a signal when that condition reaches a predetermined level. This signal is translated into a current by control means 124, which operates switch means 128. When the switch means closes, that current is applied to coil 152. When current i flows in the solenoid, the plunger is accelerated towards stop 154 and strikes that stop. The overall design of means 150 includes consideration of the force on the core as a function of position.

If element 30' does not move fast enough, a spring element, such as spring 36' can be used to assist this movement This electro-mechanical embodiment 150' is shown in FIGS. 17 and 18. The spring element 36' operates in a manner similar to that of spring 36, and system 150' operates in a manner similar to the manner just described for the mechanical system. The electromechanical system has the advantage of extra adjustments and control over the purely mechanical system shown in FIGS. 5–7. The spring 36' can be adjusted to co-operate with the coil to drive element 30' into the stop with impact force that will neutralize recoil from extremely heavy loads. On the other hand, if a light load is used, the coil can be disconnected so only the mechanical system is used, or the coil can be controlled electrically to add small amounts of energy to the movement of the impact element as the loads are increased whereby extremely accurate amounts of recoil-compensating impact can be delivered to the weapon. This will permit a user to customize his or her weapon to meet the exact needs of the particular situation. Factory settings can be used as default settings, but can be changed by the user as just discussed. In either the mechanical or the electrical or the electro-mechanical forms of the kit, the timing of impact element release can also be adjusted to create an impact at the time most effective to counter the recoil energy of a particular situation whereby the user can customize the system to meet the exact needs of the particular situation. The system may also include means for moving the initial rest position and the impact position of the impact element to further adjust the timing and size of the recoil-countering impact between the impact element and the stop element on the weapon. That is, the two end points of the travel can be moved toward or away from each other from the factory settings to effect this adjustment. This result can be achieved, for example, by including a stop element, such as a rod, in cap 14 that is threaded to that cap, with an adjusting screw on the outside the cap in contact with the rod whereby movement of the adjusting screw will move the rod distal end toward or away from the receiver for adjusting the distance between the rest and impact positions. The cap 14, itself, can also be moved by threading or unthreading it to move the impact position.

It is understood that while certain forms of the present invention have been illustrated and described herein, it is not to be limited to the specific forms or arrangements of parts described and shown. For example, the switch used to activate the electromechanical or the electrical reduction system can be located to be mechanically actuated by the trigger such as by a lever arm having one end connected to the trigger and the other end connected to the switch whereby the electrical or electromechanical embodiment is activated when the trigger is operated as discussed with respect to FIGS. 5–7, with the lever arm corresponding to the lever arm 524, with hook 522 being engaged by the trigger or an element thereof that moves when the trigger is pulled to fire a round, and end 546 moving to operate a switch that releases the impact-delivering element. The lever arm can be pivoted as shown in FIGS. 5–7 and can be re-set by a spring system such as disclosed therein, see elements 556–560 and will pivot on a pin similar to pin 526. In this case, the lever is operated from the front end by movement of the trigger mechanism and end 546 operates the switch. The lever-operated system initiates impact element movement prior to firing a round so more time can be used by the impact element in moving from the rest position into impact with the impact-receiving element. This will permit use of a slower moving impact element if necessary.

I claim:

1. In a shotgun having a recoil reducing means which includes a weight element slidably mounted on a rod element to slide between a rest location and an impact location during operation of the shotgun associated with the rod element; a spring element having one end contacting said weight element and biasing said weight element towards said impact location; and a release means for holding said weight element in said rest location and including a lock element mounted to move between a locking position engaged with said weight element and a release position in which said lock element is released from said weight element, biasing means for biasing said lock element into said locking position, and releasing means for moving said lock element into said release position to release said weight element to move from said rest location toward said impact location due to the bias exerted thereon by said spring element, said releasing means including timing means for actuating said releasing means so that said weight element reaches said impact location when recoil associated with firing the shotgun reaches a pre-determined level, the improvement comprising:

the releasing means including sensing means on the shotgun for sensing a condition of the shotgun that is associated with recoil energy, said sensing means including a pressure sensor on the barrel of the shotgun.

2. The improvement defined in claim 1 wherein said sensing means includes a strain gage on the barrel of the shotgun.

3. The improvement defined in claim 1 wherein said releasing means includes a coil controlled stop element.

4. The improvement defined in claim 1 wherein the shotgun includes a bore in the barrel and said sensing means is located in said bore.

5. The improvement defined in claim 1 wherein said weight element is located adjacent to the barrel of the shotgun.

6. The improvement defined in claim 1 further including a reset means for moving said weight from said impact location to said rest location.

7. The improvement defined in claim 6 wherein said reset means is connected to said releasing means for resetting said releasing means into a rest condition when said weight is in said rest location.

8. The improvement defined in claim 7 wherein the shotgun includes a forearm and further including means for connecting said reset means to the forearm.

9. The improvement defined in claim 1 wherein said releasing means includes means for adjusting sensitivity of said timing means.

10. The improvement defined in claim 1 wherein the shotgun includes a barrel and said sensing means is mounted on the barrel to sense a condition in the barrel.

11. The improvement defined in claim 10 further including sensitivity adjusting means connected to said sensing means.

12. The improvement defined in claim 1 wherein said releasing means includes a plurality of sensing means.

13. The improvement defined in claim 1 wherein said sensing means includes an accelerometer.

14. Means for fitting a shotgun with a recoil reduction system comprising:

A) a shotgun including gas conducting means for conducting pressurized gases generated upon the firing of a round in the shotgun from the barrel to a location spaced from the barrel;

B) means for closing said gas conducting means including sensor means for sensing a condition in the shotgun which is associated with recoil of the shotgun;

C) a stop element fixed to the barrel;

D) an impact element fixed to the shotgun to move between a first position spaced from said stop element and a second position impacting said stop element;

E) impact element moving means for moving said impact element from said first position to said second position; and F) activating means for activating said impact element moving means, said activating means including said sensor means.

15. The means defined in claim 14 wherein said sensor means is connected to an accelerometer.

16. In a shotgun having a gas port defined in the barrel thereof and a recoil reducing means which includes a weight element slidably mounted on a rod element to slide between a rest location and an impact location during operation of the shotgun associated with the rod element; a spring element having one end contacting said weight element and biasing said weight element towards said impact location; and a release means for holding said weight element in said rest location and including a lock element mounted to move between a locking position engaged with said weight element and a release position in which said lock element is released from said weight element, biasing means for biasing said lock element into said locking position, and releasing means for moving said lock element into said release position to release said weight element to move from said rest location toward said impact location due to the bias exerted thereon by said spring element, said releasing means including timing means for actuating said releasing means so that said weight element reaches said impact location at a predetermined time, the improvement comprising: sensor means for sensing a condition in the shotgun which is associated with recoil of the shotgun, said sensor means closing the gas port.

* * * * *